US006764075B2

(12) United States Patent
Nigale

(10) Patent No.: US 6,764,075 B2
(45) Date of Patent: Jul. 20, 2004

(54) TWO COLOR CHANCE DEVICE AND TWO GAMES USING THE SAME

(76) Inventor: Arvind Nigale, 2/54 Sneh-Sagar MHADA Complex, Film City Road, Malad(East), Mumbai-400 097 (IN)

( * ) Notice: Subject to any disclaimer, the term of this patent is extended or adjusted under 35 U.S.C. 154(b) by 127 days.

(21) Appl. No.: 10/091,021

(22) Filed: Mar. 5, 2002

(65) Prior Publication Data

US 2003/0168806 A1 Sep. 11, 2003

(51) Int. Cl.[7] ..... A63F 3/00

(52) U.S. Cl. ..... 273/243; 273/287; 273/146; 273/283

(58) Field of Search ..... 273/236, 243, 273/248, 254, 255, 287, 288, 138.1, 146, 237, 283; D21/363, 347, 373

(56) References Cited

U.S. PATENT DOCUMENTS 1,310,390 A * 7/1919 Clark ..... 273/248
3,433,483 A * 3/1969 Ellis ..... 273/248
4,026,557 A * 5/1977 LeBrun et al. ..... 273/243
6,062,562 A * 5/2000 Pardee ..... 273/248

* cited by examiner

*Primary Examiner*—Benjamin H. Layno
*Assistant Examiner*—Vishu K Mendiratta
(74) *Attorney, Agent, or Firm*—Brown & Michaels, PC

(57) ABSTRACT

A chance device cuboidal in shape. Three faces of the cube have a background color that is the same. The other three faces of the cube have a different color background in common. The indicia used most commonly is dots, which can be replaced with numbers or anything of the like that will show a quantity, are numbered from either one to three or four to six, or any other combination of three numbers. For the set of numbers chosen, three faces of the cube, all with the same color background, have one of the numbers present on each of the faces. The other three faces of the cube have the same set of numbers, but these numbers are present on a different color background then the other three faces of the cube. Examples of use of the described chance device includes two games, Diamonds and Killer Spider.

15 Claims, 3 Drawing Sheets

(1 of 3 Drawing Sheet(s) Filed in Color)

| | |
|---|---|
| A = PINK | |
| B = BLUE | |
| C = GREEN | |
| D = LT. BLUE | |
| H = YELLOW | |
| E = BROWN | |
| F = ORANGE | |
| G = PURPLE | |

TWO COLOR CHANCE DEVICE AND TWO GAMES USING THE SAME

BACKGROUND OF THE INVENTION

1. Field of the Invention

The invention pertains to the field of gaming chance devices. More particularly, the invention pertains to a gaming chance device used to play two different games.

2. Description of Related Art

Many board games use a chance device or chance devices to enter in or increase the amount of chance that occurs during game play. The most common chance device used are ones that are cubic in nature and all one color with a contrasting color used for an indicia, such as dots or numbers, where the dots range from one to six. A player using a chance device from the prior art, on every turn, always has an opportunity to move his or her player-piece each turn unless something on the game board itself is an obstacle, or the rules of the game prevent it during a particular situation. The present invention is a chance device that uses color and number of dots to limit the player during game play. The two-color chance device enters in an even greater amount of chance than the prior art.

SUMMARY OF THE INVENTION

A chance device comprising: a cuboidal body having six faces, where three of the faces have one background color and the faces remaining have a different background color, an indicia superimposed on the three faces with one background color and the faces remaining having a different background color, whereby the indicia is dots, numbers, or anything of the like that indicates a quantity means.

BRIEF DESCRIPTION OF THE DRAWING

The file of this patent contains at least one drawing executed in color. Copies of this patent with color drawings are provided to the Patent and Trademark Office with payment of the necessary fee.

DETAILED DESCRIPTION OF THE INVENTION

Figure 1:
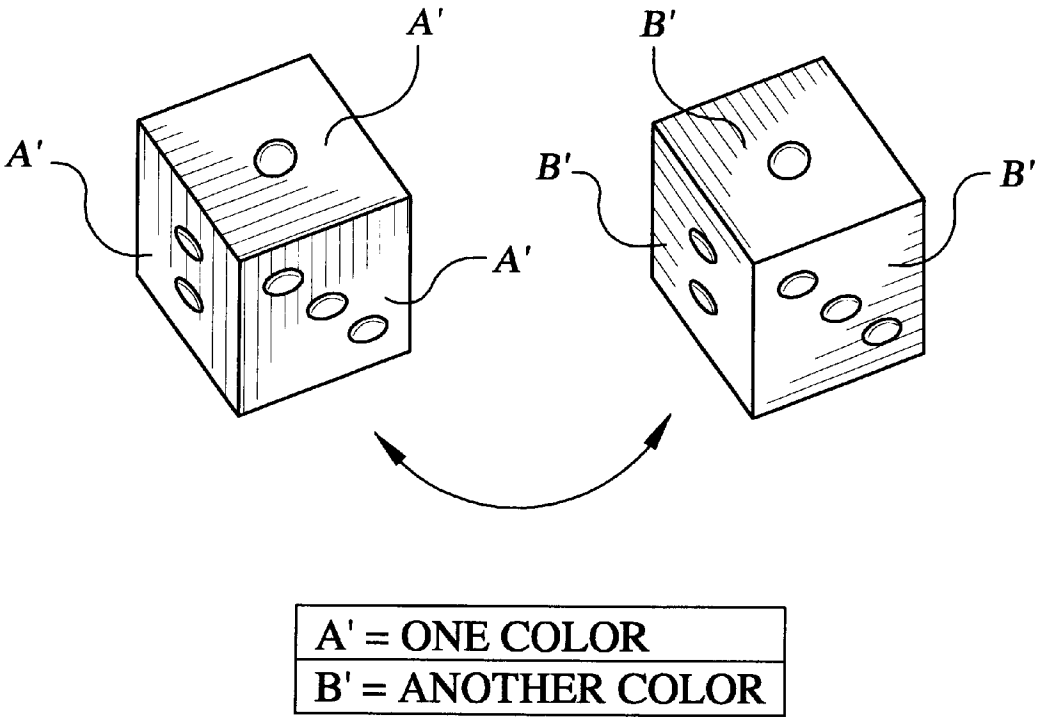
FIG. 1 shows a picture of the chance device.

In FIG. 1, the chance device of the present invention is shown. The chance device is cuboidal in shape. Three faces of the cube have a background color (A') that is the same. The other three faces of the cube have a different color background (B') in common. The indicia used most commonly is dots, which can be replaced with numbers or anything of the like that will show a quantity, are numbered from either one to three or four to six, or any other combination of three numbers. For the set of numbers chosen, three faces of the cube, all with the same color background, have one of the numbers present on each of the faces. The other three faces of the cube have the same set of numbers, but these numbers are present on a different color background than the other three faces of the cube. For example, a one dot is on one face of the cube that has a background color of blue and another face of the chance device also has one dot, but has a different background color, yellow. Two of the faces of the chance device will have two dots, where one face will have a background color of yellow and the other face will have a background color of blue. The same pattern follows for the last of the two faces that contain three dots.

Figure 2:
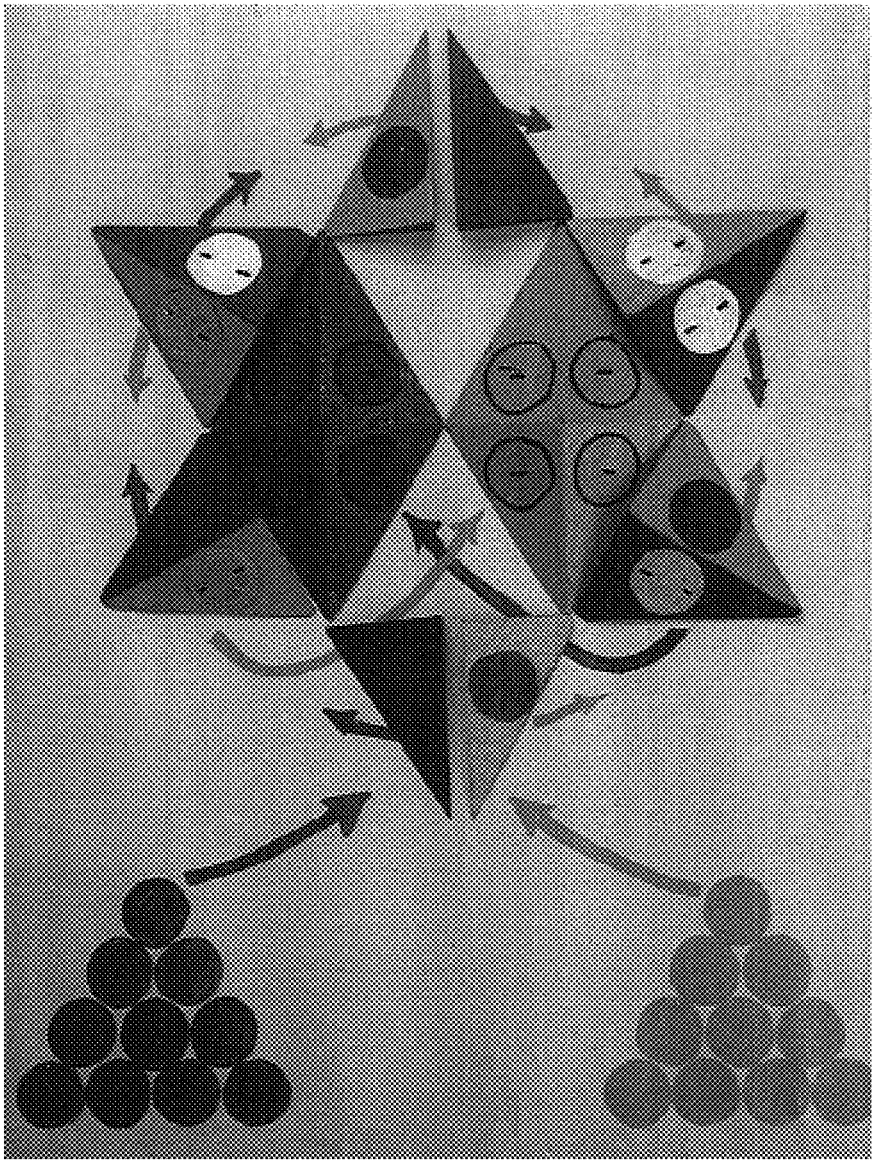
FIG. 2 shows a photograph of the game board for game number 1, Diamond.

Given the increased level of chance when using the chance device of the present invention, the level of difficulty in winning a game made for the chance device is increased. For example, a game, now to be referred to as Diamond, is a game in which there are two players. Each of the players gets ten pawns that are placed on either side of a playing board, which is preferably made out of a heavy paper such as cardboard, as seen in FIG. 2. Preferably, each player has a different color set of the colored pawns, e.g. player 1 has blue and player 2 has yellow. Preferably, pawns are in the shape of round plastic pieces. The chance device of the present invention is used in the game during each player's turn. In order for either player to move any of their pawns, the player has to roll the chance device of the present invention and have the face that lands up have the same background color as the pawn pieces the player possesses. For example, if player 1, who has the blue pawns rolls the chance device of the present invention and gets a one, two, or three with a yellow background, player 1 does not get to move any of their pawns and player 1's turn is over. In order for player 2 to move any of his or her pawns, they must role a one, two, or three with the background color of yellow or their turn is forfeited. When a player does win the right to move his or her pawns on the game board, they may move one of the pawns one space, i.e. from one blue space to another blue space, or one yellow space to another yellow space, for every dot present or other indicia, on the face of the chance device that is face up, or they may move two pawns for the amount in sum present on the face of the chance device displayed. For example, player 1 rolls a three with the color background of blue. Player 1 may move one blue pawn piece in a clockwise direction (the direction is counterclockwise for player 2, with the yellow pawns), as indicated by the game board in FIG. 2, or two pawn pieces with one of the pawn pieces moving one space and the other moving two spaces. No more than two pawns can be present in one space on the board at a time. Player 1 and player 2 are both moving their pawns around the game board, each completing a complete circle in their specified directions, with the goal of getting at least four of their pawns into their own color center diamond.

In an alternative embodiment, the game board is three-dimensional and preferably made of plastic. The pawn pieces used with this game board are preferably shaped like an inverted "T", where the horizontal portion of the "T" makes contact with the game board and is made of brass. When at least four inverted "T" pawns are placed into their own color center diamond they complete a circuit, causing a light bulb below the center diamond to become lit.

Besides using the chance device of the present invention to determine when players move their pawns, the chance device also plays a role in the chance that the pawns may be "killed" by the opposing player's pawn. The spaces on the game board that contain red circles are places were "killing" of the player's pawns is allowed. In order to do this, a player has to roll the chance device so that their background color is facing up, move their single pawn over the opponent's single pawn, and have a place to land. Two pawns of one color can kill two pawns of an opposing color as long as the chance device background color is correct so as to allow the pawns to be moved, and that there is landing space that can occupy the two pawns doing the jumping. Again, the same requirements are in force for a single pawn also. For example, if player 1 rolls a two with a blue background, player one can move his or her pawns in a clockwise direction. If there were two of player 1's pawns on a space adjacent to the space player 2's pawns are sitting on, and in order to continue in the clockwise direction associated with their circle the two opponent's yellow pawns are in the way, using the roll of the two, each of player 1's pawns go one space, jumping over the two yellow pawns, and "killing" them, which effectively removes them from the game. This "killing" could not have been made if player 1 had already had one pawn sitting in the landing space. One pawn can not kill two pawns, one pawn kills one pawn and two pawns kills two pawns.

Figure 3:
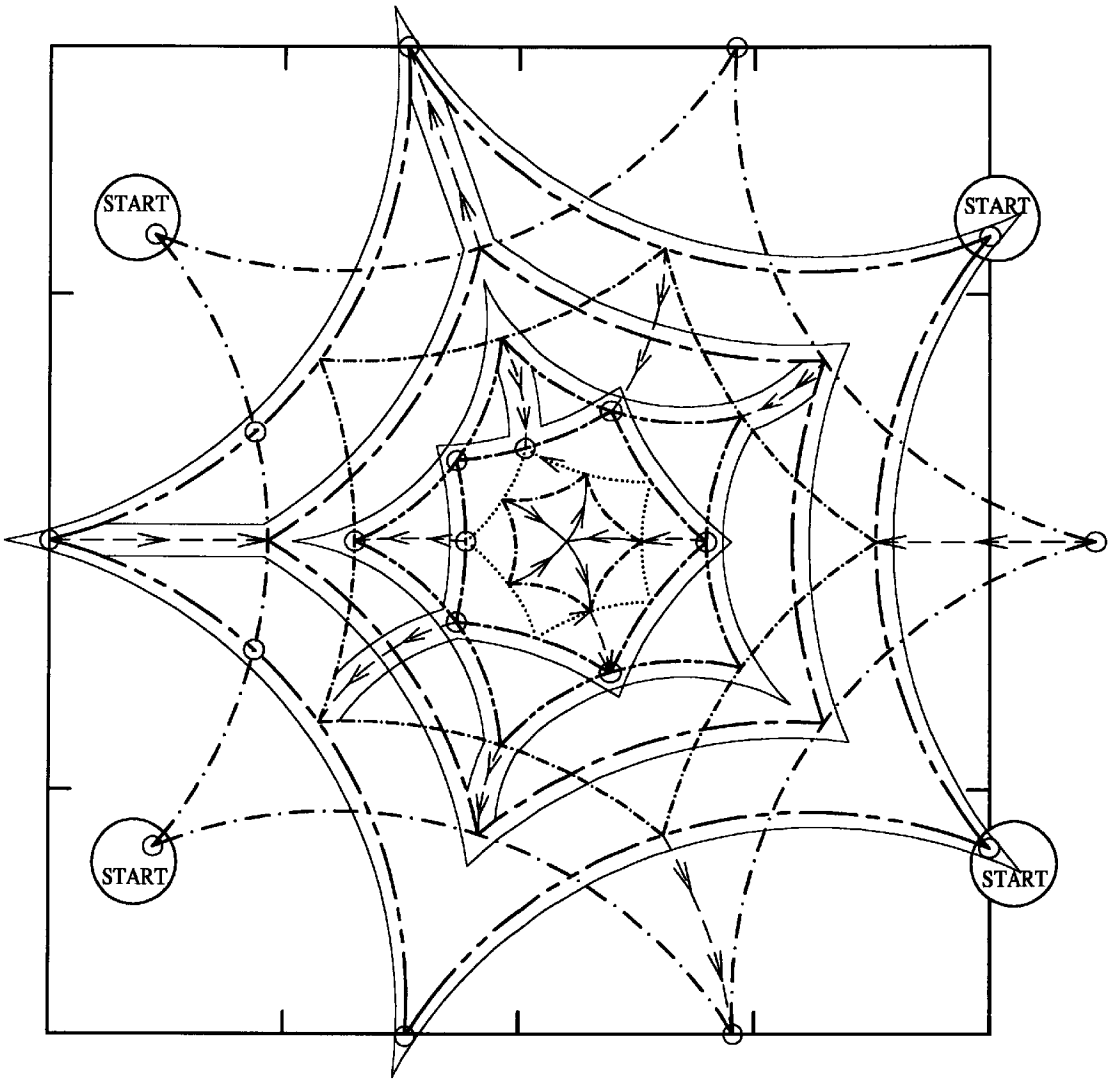
FIG. 3 shows the game board for game number 2, Killer Spider.

Another example of a game played using the chance device of the present invention, of which gives an increased level of chance and difficulty in winning, is a game, now to be referred to as Killer Spider. Killer Spider is a two player game where each player gets either two blue spiders or two pink spiders with the spiders being preferably made of plastic or a similar material and containing a peg appendage with which can be placed in the game board. Each player starts off on opposite sides of two different colored concentric pentagons, see FIGS. 3 and 4. The spiders move from point to point of each of the concentric pentagons, moving further into smaller concentric pentagons, by following the inward arrows only, until either one of the player's spiders reaches the center, to capture the prey in the middle. In order to move the spiders, a player has to roll the chance device and get a face up that has the matching corresponding color to the spider pieces. For example, if player 1 has blue spiders and rolls a three with a pink background, player 1 does not get to move his or her spiders. If player 1 had rolled a three with a blue background, then he or she would have been able to move either one spider three places or two spiders, one moving one space, and the other moving two spaces. Each player follows a different set of colored concentric pentagons in towards the center of the game board. For example, the player with the blue spiders, in this case player 1, follows an inward path that goes from blue to pink, to yellow, to light blue, to brown, to orange, to purple, and finally to the center of the board. The player with the pink spiders, in this case player 2, follows an inward path that goes from pink to blue, to green, to light blue, to brown, to orange, to purple, and finally to the center of the board. Once a player reaches the center of the board, and captures the prey, this player has to make it back through the concentric pentagons, following the arrows going outward, to their own color concentric pentagon with the prey. The player that did not capture the prey has to capture the other player's spider that has the prey and "kill" it before it gets to it's own colored concentric pentagon. For example, if player 2, which has the pink spiders, captures the prey in the center, player 2 now has to get this spider back to the beginning pink concentric pentagon, by following any path along the outward pointing arrows as indicated on the game board, see FIG. 3. Player 1 has to "kill" the other spider by going back through the concentric pentagons through any path so long as player 1 follows the direction of outward pointing arrows. If player 2, who captured the prey, makes it back to the pink pentagon first, he or she wins, if player 1 "kills" player 2's spider with the prey by landing on that spider, then player 1 wins. Player 1 can use either of his or her spiders to land on and kill player 2's spider with the prey.

As indicated in the two examples, the chance device of which three faces are of one background color and three faces of the chance device are another background color, increases the excitement, the level of difficulty, and the chance involved in playing games.

Either of the two games given as examples can be played on a computer, console, or similar electronic device, with the computer, console, or electronic device being the second player. For example, the game board, the playing pieces, and the chance device would all be present on the computer screen or similar screen, only requiring the user or player 1 to push a button to move their playing pieces around and play. Furthermore, the games can also be played online (e.g. on the Internet), where one player is located at one geographical location and the other player is located at another geographic location.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of playing a game comprising the steps of:

a) providing a player 1 a plurality of mono-colored pieces;

b) providing a player 2 a plurality of mono-colored pieces in a different color than player 1's pieces;

c) providing a chance device having a cuboidal body having six faces; wherein three of the faces are a first background color that matches the color of player 1's pieces; a second background color on the remaining faces that matches the color of player 2's pieces, and indicia superimposed on each face wherein the indicia are dots, numbers, or any mark that indicates a quantity means;

d) providing a game board made up of diamond shaped spaces and a center diamond for each player, wherein spaces within the diamond shaped spaces are color coded to match player 1's pieces and player 2's pieces and red circles present within at least one of each color of the color coded spaces wherein players move; and e) playing the game wherein each player takes successive turns, wherein each turn comprises the steps of:

i) rolling the chance device, ii) determining whether the face of the chance device that is facing up when the chance device is done rolling is the color of the player's pieces, iii) if the face of the chance device that lands face-up is not the color of the player's pieces then the player does not move any pieces, iv) if the face that is facing up is the color of the player's pieces then the player moves one or more pieces to an adjacent space of the same color as the piece for a quantity of total moves as indicated by the indicium superimposed on the face of the chance device that lands face-up when the chance device is done rolling, v) if the player moves a piece past a space that has a red circle and that space is occupied by one of the other player's pieces, such other player's piece is removed from the game; and i) wherein the game is won if the player has a predetermined number of pieces come to rest in the center diamond.

2. The method of claim 1, wherein no more than two of the mono-colored pieces can occupy more than one space on the game board.

3. The method of claim 1, wherein the mono-colored pieces are pyramid shaped.

4. The method of claim 1, wherein the at least four of the mono-colored pieces come to rest in the diamond that is present in the center of the playing board, wherein the pieces cause a light bulb to light up.

5. The method of claim 1, wherein the player's pieces, the playing board comprising different color spaces, and centrally located diamond, and the chance device are provided as representations displayed on a user's computer, console, or similar electronic device.

6. The method of claim 1, wherein piece movement of the player's is determined by a computer program.

7. A method of playing a game comprising the steps of:

a) providing a player 1 a plurality of mono-colored pieces;

b) providing a player 2 a plurality of mono-colored pieces;

c) providing a chance device having a cuboidal body having six faces; wherein three of the faces are a first background color that matches the color of player 1's pieces; a second background color on the remaining faces that matches the color of player 2's pieces, and indicia superimposed on each face wherein the indicia are dots, numbers, or any mark that indicates a quantity means;

d) providing a game board made up of different colored concentric pentagons, and a center concentric pentagon in which a separate playing piece is present, wherein each point of the concentric pentagons is a space in which the players move, each player having a plurality of colored concentric rings in which the other player does not travel and a set of concentric pentagons in which both player's travel;

e) playing the game wherein each player takes successive turns, wherein each turn comprises the steps of:

i) rolling the chance device, ii) determining whether the face of the chance device that is facing up when the chance device is done rolling is the color of the player's pieces, iii) if the face of the chance device that lands face-up is not the color of the player's pieces than the player does not move any pieces, and iv) if the face that is facing up is the color of the player's pieces then the player moves one or more pieces from one space to another space on the concentric pentagons for a quantity of total moves as indicated by the indicium superimposed on the face of the chance device that lands face-up when the chance device is done rolling, v) if players do not have the separate piece, players move one or more of their pieces from space to space towards the center of the board to obtain the separate piece, vi) if the separate piece is obtained by the player, the player moves the separate piece and the player's piece from the center of the board to the outside concentric pentagon of the board, and vii) if the other player does have the separate piece, then the player without the piece moves from space to space and lands on the player with the separate piece, such player loses the game.

8. The method of claim 7, wherein the plurality of colored concentric rings in which only one player travels is different than the plurality of colored concentric rings in which only the other player travels.

9. The method of claim 7, wherein either of the player's pieces may be used to kill the other player's piece having the separate playing piece from the center concentric pentagon.

10. The method of claim 7, wherein the player's pieces, the playing board comprising colored concentric pentagons, the chance device, and the prey are provided as representations displayed on a user's computer, console, or similar electronic device.

11. The method of claim 7, wherein piece movement of player's is determined by a computer program.

12. A kit for a game having:

a) a plurality of player 1 mono-colored pieces;

b) a plurality of player 2 mono-colored pieces in a different color than players's pieces;

c) a chance device having a cuboidal body having six faces; wherein three of the faces are a first background color that matches the color of player 1's pieces; a second background color on the remaining faces that matches the color of player 2's pieces, and indicia superimposed on each face wherein the indicia are dots, numbers, or any mark that indicates a quantity means; and d) a game board made up of diamond shaped spaces and a center diamond for each player, wherein spaces within the diamond shaped spaces are color coded to match player 1's pieces and player 2's pieces and red circles present within at least one of each color of the color coded spaces wherein players move.

13. The kit of claim 12, wherein the player pieces, the gaming board, the diamond shaped spaces, and the chance device are provided as representations displayed on a user's computer, console, or similar device.

14. A kit for a game comprising:

a) a plurality of player 1 mono-colored pieces;

b) a plurality of player 2 mono-colored pieces in a different color than player 1's pieces;

c) a chance device having a cuboidal body having six faces; wherein three of the faces are a first background color that matches the color of player 1's pieces; a second background color on the remaining faces that matches the color of player 2's pieces, and indicia superimposed on each face wherein the indicia are dots, numbers, or any mark that indicates a quantity means; and d) providing a game board made up of different colored concentric pentagons, and a center concentric pentagon in which a separate playing piece is present, wherein each point of the concentric pentagons is a space in which the players move, each player having a plurality of colored concentric rings in which the other player does not travel and a set of concentric pentagons in which both player's travel.

15. The kit of claim 14, wherein the player pieces, the game board of concentric pentagons, the separate playing piece, and the chance device are provided as representation displayed on a user's computer, console, or similar device.

* * * * *